US010208269B2

(12) United States Patent
Gao et al.

(10) Patent No.: US 10,208,269 B2
(45) Date of Patent: Feb. 19, 2019

(54) LOW VISCOSITY ESTER LUBRICANT AND METHOD FOR USING

(71) Applicants: Jason Z. Gao, Rose Valley, PA (US); Samuel C. Bainbridge, Philadelphia, PA (US); Dennis A. Gaal, Glassboro, NJ (US); Tomasz M. Young, Philadelphia, PA (US)

(72) Inventors: Jason Z. Gao, Rose Valley, PA (US); Samuel C. Bainbridge, Philadelphia, PA (US); Dennis A. Gaal, Glassboro, NJ (US); Tomasz M. Young, Philadelphia, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 126 days.

(21) Appl. No.: 14/546,509

(22) Filed: Nov. 18, 2014

(65) Prior Publication Data

US 2016/0130524 A1 May 12, 2016

Related U.S. Application Data

(60) Provisional application No. 61/919,931, filed on Dec. 23, 2013.

(51) Int. Cl.

| | |
|---|---|
| ***C10M 173/00*** | (2006.01) |
| ***C10M 159/06*** | (2006.01) |
| ***C10M 145/14*** | (2006.01) |
| ***C10M 157/00*** | (2006.01) |
| ***C10M 169/04*** | (2006.01) |
| ***C10M 105/32*** | (2006.01) |
| ***C10M 105/34*** | (2006.01) |
| ***C10M 143/04*** | (2006.01) |

(52) U.S. Cl.

CPC ..... *C10M 169/041* (2013.01); *C10M 105/32* (2013.01); *C10M 105/34* (2013.01); *C10M 143/04* (2013.01); *C10M 145/14* (2013.01); *C10M 169/048* (2013.01); *C10M 2205/022* (2013.01); *C10M 2205/04* (2013.01); *C10M 2207/2815* (2013.01); *C10M 2207/2825* (2013.01); *C10M 2209/084* (2013.01); *C10N 2220/022* (2013.01); *C10N 2230/02* (2013.01); *C10N 2230/06* (2013.01); *C10N 2230/08* (2013.01); *C10N 2240/10* (2013.01)

(58) Field of Classification Search

CPC . C10M 145/14; C10M 105/36; C10M 105/34

USPC ..... 508/315, 451, 469, 473

See application file for complete search history.

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,191,498 | A | 2/1940 | Reiff |
| 2,387,501 | A | 10/1945 | Dietrich |
| 2,436,347 | A | 2/1948 | Zimmer et al. |
| 2,443,264 | A | 6/1948 | Mikeska |
| 2,471,115 | A | 5/1949 | Mikeska |
| 2,526,497 | A | 10/1950 | Mikeska |
| 2,591,577 | A | 4/1952 | McDermott |
| 2,655,479 | A | 10/1953 | Munday et al. |
| 2,666,746 | A | 1/1954 | Munday et al. |
| 2,719,125 | A | 9/1955 | Roberts |
| 2,719,126 | A | 9/1955 | Fields et al. |
| 2,721,877 | A | 10/1955 | Popkin et al. |
| 2,721,878 | A | 10/1955 | Popkin |
| 3,036,003 | A | 5/1962 | Verdol |
| 3,087,932 | A | 4/1963 | Little, Jr. |
| 3,087,936 | A | 4/1963 | Le Suer |
| 3,172,892 | A | 3/1965 | Le Suer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |

(Continued)

FOREIGN PATENT DOCUMENTS

| | | | |
|---|---|---|---|
| CA | 1094044 | A | 1/1981 |
| EP | 0471071 | B1 | 8/1995 |

(Continued)

OTHER PUBLICATIONS

Kipp, E.M., "Synthetic lubricants defined: components and materials of non-petroleum origin," Industrial Lubrication and Tribology, 1980, pp. 52-53.

(Continued)

*Primary Examiner* — Prem C Singh
*Assistant Examiner* — Francis C Campanell
(74) *Attorney, Agent, or Firm* — Robert A. Migliorini

(57) ABSTRACT

According to the present disclosure, there is provided a high-temperature lubricant composition. The composition has an amount of an ester. The ester exhibits a kinematic viscosity at 100° C. of 1 to 4 centistokes and a kinematic viscosity ratio at 150° C./100° C. of 0.6 or higher. The composition is at a temperature of 100° C. to 150° C. There is also another lubricating composition having the ester and a polymeric viscosity modifier. There are also methods for using the lubricating compositions in the crankcase of an engine.

12 Claims, 2 Drawing Sheets

(56) References Cited

U.S. PATENT DOCUMENTS

| | | | |
|---|---|---|---|
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,751,365 | A | 4/1973 | Piasek et al. |
| 3,734,150 | A | 5/1973 | Holmberg et al. |
| 3,755,433 | A | 8/1973 | Miller et al. |
| 3,756,953 | A | 9/1973 | Piasek et al. |
| 3,770,854 | A | 11/1973 | Morris et al. |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,948,800 | A | 4/1976 | Meinhardt |
| 4,100,082 | A | 7/1978 | Clason et al. |
| 4,234,435 | A | 11/1980 | Meinhardt et al. |
| 4,426,305 | A | 1/1984 | Malec |
| 4,454,059 | A | 6/1984 | Pindar et al. |
| 4,501,678 | A | 2/1985 | Katayama et al. |
| 4,519,932 | A | 5/1985 | Schnur et al. |
| 4,758,362 | A | 7/1988 | Butke |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,941,984 | A | 7/1990 | Chamerlin, III et al. |
| 4,956,122 | A | 9/1990 | Watts et al. |
| 5,034,141 | A | 7/1991 | Beltzer et al. |
| 5,034,142 | A | 7/1991 | Habeeb et al. |
| 5,084,197 | A | 1/1992 | Galic et al. |
| 5,503,762 | A | 4/1996 | Bongardt et al. |
| 5,659,820 | A | 8/1997 | Taniguchi et al. |
| 5,693,598 | A | 12/1997 | Abraham et al. |
| 5,705,458 | A | 1/1998 | Roby et al. |
| 5,824,627 | A | 10/1998 | McConnachie et al. |
| 5,837,657 | A | 11/1998 | Fang et al. |
| 5,906,968 | A | 5/1999 | McConnachie et al. |
| 6,010,987 | A | 1/2000 | Stiefel et al. |
| 6,034,039 | A | 3/2000 | Gomes et al. |
| 6,110,878 | A | 8/2000 | McConnachie et al. |
| 6,143,701 | A | 11/2000 | Boffa |
| 6,153,564 | A | 11/2000 | Arunasalam et al. |
| 6,232,276 | B1 | 5/2001 | Stiefel et al. |
| 6,426,324 | B1 * | 7/2002 | Lai ..... C10M 133/12 252/401 |
| 6,689,725 | B1 | 2/2004 | Gao |
| 6,730,638 | B2 | 5/2004 | Farng et al. |
| 2004/0192565 | A1 * | 9/2004 | Thiel ..... C10M 159/12 508/454 |
| 2007/0105728 | A1 | 5/2007 | Phillips et al. |
| 2008/0020953 | A1 * | 1/2008 | Kamano ..... C10M 141/06 508/287 |
| 2008/0132432 | A1 * | 6/2008 | Mathur ..... C10M 129/32 508/108 |
| 2008/0242568 | A1 * | 10/2008 | Poirier ..... C10M 111/04 508/485 |
| 2011/0039740 | A1 * | 2/2011 | Kitching ..... C10M 105/34 508/459 |

FOREIGN PATENT DOCUMENTS

| | | | |
|---|---|---|---|
| EP | 1225213 | A1 | 7/2002 |
| JP | 2001240884 | A | 9/2001 |
| JP | 2002146374 | A | 5/2002 |
| JP | 2011057759 | A | 3/2011 |
| JP | 2012224653 | A | 11/2012 |
| WO | 98/26030 | A1 | 6/1998 |
| WO | 99/47629 | A1 | 9/1999 |
| WO | 99/66013 | A1 | 12/1999 |
| WO | 00/34409 | A1 | 6/2000 |
| WO | 2005/007787 | A1 | 1/2005 |
| WO | 2008/104745 | A2 | 9/2008 |

OTHER PUBLICATIONS

Kurth, Todd L. et al., "Non-linear adsorption modeling of fatty esters and oleic estolide esters via boundary lubrication coefficient of friction measurements," Wear, 2007, vol. 262, pp. 536-544.

The International Search Report and Written Opinion of PCT/US2014/066340 dated Mar. 2, 2015.

* cited by examiner

LOW VISCOSITY ESTER LUBRICANT AND METHOD FOR USING

CROSS-REFERENCE TO RELATED APPLICATIONS

This application claims priority to U.S. Provisional Application Ser. No. 61/919,931 filed Dec. 23, 2013 which is herein incorporated by reference in its entirety.

FIELD

The present disclosure relates to a lubricant composition useful in high temperature applications. The present disclosure further relates to a lubricant composition useful in blends with viscosifying polymers. The present disclosure still further relates to a method for using the lubricant composition as engine oil.

BACKGROUND

High efficiency lubricants generally offer lower friction across a wide range of temperatures and conditions. Friction can result not only from surface contact but also from the presence of viscous medium between the mating surfaces of mechanical components. At a given temperature under relatively low load or high speed conditions, two contacting surfaces are separated by a full lubricant fluid film and the resulting friction is referred to as hydrodynamic friction and is mainly determined by the viscosity of the lubricant. In a hydrodynamic lubrication regime, lower lubricant viscosity leads to higher energy efficiency. On the other hand, under high load at low speed or low viscosity conditions, two contacting surfaces will be rubbing against each other and friction is determined by the friction coefficient of the chemical film formed at the two surfaces. This lubrication regime is referred to as the boundary lubrication regime. The lubrication regime in between the two mentioned is referred to as the mixed lubrication regime.

Thus, an ideal lubricant will exhibit a high viscosity at its highest operating temperature to avoid surface contact while exhibiting a relatively low viscosity at the rest of the operating temperature range in order to minimize friction. For a lubricant operating between 100° C. to 150° C., the preferred base fluid would have a high $KV_{150}/KV_{100}$ ratio. In the event surface contact does occur under high load and low speed conditions, the ideal lubricant will also form a chemical film with a low friction coefficient.

Attempts have been made to use conventional lubricants, such as Groups I, II, III, IV, and V base stocks, in high-temperature applications, such as in high-performance motors and engines. Many conventional lubricants, however, cannot maintain sufficient film thickness at high temperature (e.g., 150° C.) to provide protection in areas like journal bearings while maintaining low hydrodynamic friction at lower temperatures (e.g., 100° C.). Thus, it is highly desirable to have lubricants with viscosities at high temperatures as close to that at low temperatures as possible.

One means of addressing lubrication performance at high temperatures is selection of lubricant base stock. It is difficult to select a conventional lubricant base stock that provides both sufficiently high viscosity at high temperatures and low viscosity at low temperatures. Conventional high viscosity base stocks may provide sufficiently high viscosity at high temperatures but may be too viscous at low temperatures. Conventional low viscosity base stocks may provide sufficient fluidity at low temperatures but provide insufficient viscosity at high temperatures.

A second approach is to improve viscosity-temperature response by adding a polymer to the lubricant formulation. Such polymer is called a viscosity modifier or viscosity index improver (VII). The function of a polymeric viscosity modifier is to increase the high temperature viscosity without significantly increasing the low temperature viscosity. The resulting viscosity-temperature relationship is determined by the base oil viscosity-temperature relationship and the chemical structure of the polymeric viscosity modifier.

Another means of addressing lubricant performance at high temperatures is to employ friction modifying additives, such as molybdenum dithiocarbamate (MoDTC) or glycerol mono-oleate (GMO) in boundary lubrication conditions. However, such friction modifying additives degrade in performance over time. In addition, wear might result if the surfaces are not sufficiently separated by an oil film, despite the presence of a friction modifier.

It would be desirable to have a lubrication system that provides effective performance at high temperatures. It would be desirable to have a lubrication base stock that provides sufficient viscosity at high temperatures yet provide sufficient fluidity at low temperatures. It would be further desirable to have lubrication base stocks that provide such performance without the need for friction modifying additives.

SUMMARY

Figure 1:
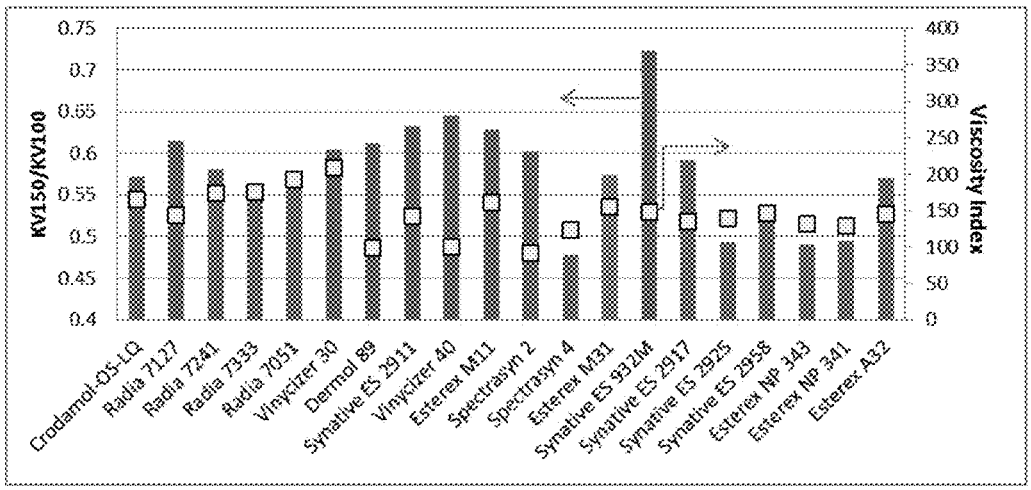
FIG. 1 depicts a data plot and graph for $KV_{150}/KV_{100}$ Ratio and viscosity index for the Esters of Table 2.

According to the present disclosure, there is provided a high-temperature lubricant composition. The composition has an amount of an ester. The ester exhibits a kinematic viscosity at 100° C. of 1 to 4 centistokes and a kinematic viscosity ratio at 150° C./100° C. of 0.6 or higher. The composition is at a temperature of 100° C. to 150° C.

Further according to the present disclosure, there is a method for improving the operating efficiency of an engine having a crankcase lubricant. The above lubricant composition is added to the crankcase.

Further according to the present disclosure, there is a lubricant composition. The composition has a polymeric viscosity modifier in an amount of 5 wt % to 35 wt % and an amount of an ester at 95 wt % to 5 wt % based on the total weight of the composition. The ester exhibits a kinematic viscosity at 100° C. of 1 to 4 centistokes and a kinematic viscosity ratio at 150° C./100° C. of 0.60 or higher. The amount of polymeric viscosity modifier and the amount of the ester are present at 90 wt % or more of the composition based on the total weight of the composition. The resulting composition has a $KV_{150}/KV_{100}$ ratio of 0.55 or higher.

Further according to the present disclosure, there is a method for improving the operating efficiency of an engine having a crankcase lubricant. The above lubricant composition is added to the crankcase.

DETAILED DESCRIPTION

All numerical values within the detailed description and the claims herein are modified by "about" or "approximately" the indicated value, and take into account experimental error and variations that would be expected by a person having ordinary skill in the art.

The lubrication composition provides effective lubrication performance at high temperatures, i.e., 100° C. or more, and, particularly 100° C. to 150° C., and under boundary, mixed, and hydrodynamic conditions. The lubrication composition provides sufficient viscosity at high temperatures yet provides sufficient fluidity at low temperatures. The lubrication composition provides such performance without the need for conventional friction modifying additives.

The effective lubrication performance of the composition of the present disclosure is due to the presence of low viscosity esters. The low viscosity ester exhibits a kinematic viscosity at 100° C. of from 1 to 4 centi-Stokes (cSt) and more preferably from 1.3 to 3.5 cSt according to ASTM D445. The low viscosity esters exhibit a kinematic viscosity ratio ($KV_{150}/KV_{100}$), i.e., ratio of kinematic viscosity measured at 150° C. and 100° C., of 0.6 or higher. The method for kinematic viscosity measurement is measured according to ASTM D445. The low viscosity esters exhibit an average coefficient of friction at 140° C. from 1.0 or lower, more preferably 0.8 or lower, and most preferably 0.5 to 0.8 measured using PCS Instruments MTM (Mini Traction Machine) at test conditions as follows: load of 37 N (1 GPa contact pressure for ¾ inch steel ball specimen), speed 0-100 mm/s, and 50% slide-to-roll ratio. When a polymeric viscosity modifier is employed in conjunction with the low viscosity ester base stocks, the resulting composition has a $KV_{150}/KV_{100}$ ratio of 0.55 or higher.

The low viscosity esters can be any ester or mixture of esters that individually exhibit the kinematic viscosity and ratio parameters disclosed herein. Examples of suitable low viscosity esters include ethylhexyl stearate, 2-ethylhexyl laurate, isobutyl stearate, 2-ethylhexyl oleate, butyl stearate, isobutyl oleate, ethylhexyl isononanoate, isodecyl pelargonate, diisobutyl adipate, isononyl heptanoate, ethylhexyl palmitate, isononyl otanoate, isononyl isononanoate, isodecyl isononanoate, isodecyl ethylhexanoate, isotearyl isononanoate, diisooctyl adipate, diethylhexyl adipate, di-n-octyl adipate, diisopropyl sabacate, diisobutyl sabacate, diisohexyl sabacate, diisobutyl azelate, diisooctyl azelate, diethylhexyl azelate, diisohexyl azelate. Classes of suitable esters include saturated and unsaturated monoesters, diesters such as succinates, adipates, azelates, and sebacates, polyol esters such as neopentyl glycol (NPG) and trimethylopropanes (TMP) esters. Other non-limiting classes of suitable esters include aliphatic esters of 8 to 24 carbons.

Preferred lubricant compositions of the present disclosure are utilized at temperatures of 100° C. or more and particularly 100° C. to 150° C. Lubricant compositions can, however, be used in applications at less than 100° C.

The low viscosity esters of the present disclosure can, if desired, be blended with conventional lubricating base stocks to form lubricating compositions. The esters can be blended in minor proportions with the conventional base stocks to incrementally modify and improve the lubricating performance of such conventional base stocks. Further, conventional lubricating base oils can be blended in minor proportions with the ester base stocks to modify the lubricating performance of the esters.

Conventional lubricating base stocks include natural oils and synthetic oils. Natural and synthetic oils (or mixtures thereof) can be used as unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. Purification processes known in the art include solvent extraction, secondary distillation, acid extraction, base extraction, filtration, and percolation. Rerefined oils are obtained by processes analogous to refined oils but using oil that has been previously used as feedstock.

Groups I, II, III, IV and V are broad categories of conventional base stocks developed and defined by the American Petroleum Institute (API Publication 1509) to create guidelines for lubricant base stocks. Group I base stocks have a viscosity index of 80 to 120 and contain greater than 0.03% sulfur and less than 90% saturates. Group II base stocks have a viscosity index of 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. The table below summarizes properties of each of these five groups.

| | Base Stock Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Polyalphaolefins (PAO) | | |
| Group V | All other base stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Additional well known conventional base stocks include Group II and/or Group III hydroprocessed or hydrocracked base stocks and synthetic oils, such as polyalphaolefins, alkyl aromatics and synthetic esters.

A detailed description of conventional Group I, II, and III base stocks can be found in "Synthetics, Mineral Oils and Bio-Based Lubricants, Chemistry and Technology" Edited by L. R. Rudnick, published by CRC Press, Taylor & Francis, 2005, which is incorporated herein by reference.

Conventional Group V base stocks, including, for example, esters, alcohols, ethers, acids, and other O, S, and N containing base stocks are useful in combination with the low viscosity esters of the present disclosure. Conventional esters of Group V differ from the low viscosity esters of the present disclosure in viscosity with respect to kinematic viscosity and $KV_{150}/KV_{100}$ ratios, as conventional esters have typically exhibited kinematic viscosities at 100° C. of 4 $mm^2/s$ or higher and lower $KV_{150}/KV_{100}$ ratios (<0.5) than the low viscosity esters of the present disclosure. Group V esters include monoesters, diesters (such as ditridecyl adipate), polyol esters, including pentherythyol, and phthalate esters. Typically, Group V esters differ from the low viscosity esters of the present disclosure in their detailed chemical structures, which are manifest in differences in kinematic viscosity and $KV_{150}/KV_{100}$ ratios. The alkylated aromatics of choice are alkylbenzene, alkylated naphthalene and other alkylated aromatics such as alkylated diphenylether, diphenylsulfide, biphenyl, and polyalkylene glycol. A detailed description of suitable Group V base stocks can be found in "Synthetics, Mineral Oils and Bio-Based Lubricants, Chemistry and Technology" edited by L. R. Rudnick, published by CRC Press, Taylor & Francis, 2005.

Viscosity index or VI is a traditional means of measuring viscosity-temperature relationship but is not a suitable measure of the viscosity-temperature relationship between 100° C. and 150° C. for the following reasons: (i) viscosity index calculation is based on an empirical relationship and the value of viscosity index is dependent on the viscosity of the fluid, and (ii) viscosity index is based on the kinematic viscosity measurements at 40° C. and 100° C.

Conventional synthetic oils include hydrocarbon oils. Hydrocarbon oils include oils of polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used in synthetic hydrocarbon oils. By way of example, PAOs derived from C8, C10, C12, and C14 olefins and mixtures thereof may be utilized. See U.S. Pat. Nos. 4,956,122; 4,827,064; and 4,827,073.

The number average molecular weights of the PAOs typically vary from 250 to 3,000. The PAOs are typically comprised of relatively low molecular weight hydrogenated polymers or oligomers of alphaolefins that include, but are not limited to, C2 to C32 alphaolefins with the C8 to C16 alphaolefins, such as 1-octene, 1-decene, and 1-dodecene being preferred. The preferred polyalphaolefins are poly-1-octene, poly-1-decene, and poly-1-dodecene and mixtures thereof and mixed olefin-derived polyolefins. However, the dimers of higher olefins in the range of C14 to C18 may be used to provide low viscosity base stocks of acceptably low volatility. Depending on the viscosity grade and the starting oligomer, the PAOs may be predominantly trimers and tetramers of the starting olefins with minor amounts of the higher oligomers having a viscosity range of 1 to 12 cSt. PAO's may also be made at higher viscosities up to 3000 cSt (100° C.).

The low viscosity ester base stocks of the present disclosure can be present in lubricating compositions at from 5 wt % to 100 wt % based on the total weight of the composition, preferably 80 wt % or more, and more preferably 90 wt % or more based on the total weight of the composition. The balance of the compositions (other than the low viscosity esters) can be selected from among the conventional lubricating base stocks and additives disclosed herein.

Lubricant compositions of the present disclosure optionally contain polymers for the purpose of adjusting viscosity. For such embodiments, the composition will have a polymeric viscosity modifier in an amount of 5 wt % to 35 wt % and an amount of a low viscosity ester at 95 wt % to 5 wt % based on the total weight of the composition. The ester will exhibit a kinematic viscosity at 100° C. of 1 to 4 centistokes and a kinematic viscosity ratio at 150° C./100° C. of 0.60 or higher. The resulting composition has a $KV_{150}/KV_{100}$ ratio of 0.55 or higher. Polymers can be natural or synthetic and will typically be miscible in oil. Examples of polymers include linear or star-shaped polymers and copolymers of methacrylate, butadiene, olefins, or alkylated styrenes. Additional examples are polymethacrylate, polymethylmethacrylate, copolymers of ethylene and propylene, hydrogenated block copolymers of styrene and isoprene and polyacrylates. Further according to the present disclosure, there is a lubricant composition. For such embodiments, the amount of the polymeric viscosity modifier and the amount of the ester will be present at 90 wt % or more of the composition based on the total weight of the composition.

Polymeric viscosity modifiers (also known as VI improvers and viscosity index improvers) provide lubricants with high and low temperature operability. These additives impart shear stability at elevated temperatures and acceptable viscosity at low temperatures.

Suitable polymeric viscosity modifiers include high molecular weight (polymeric) hydrocarbons, polyesters and viscosity index improver dispersants that function as both a viscosity index improver and a dispersant. Typical molecular weights of these polymers are between 10,000 to 1,000,000, more typically 20,000 to 500,000, and even more typically between 50,000 and 200,000.

Examples of suitable viscosity index improvers are polymers and copolymers of methacrylate, butadiene, olefins, or styrenes. A suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, or styrene and butadiene. Specific examples include olefin copolymer and styrene-hydrogenated isoprene copolymer of 50,000 to 200,000 molecular weight.

As previously indicated, viscosity modifiers are used in an amount of 1 to 35 wt % on an as received basis, preferably 5 to 35 wt % on an as-received basis.

Because viscosity modifiers are usually supplied diluted in a carrier or diluent oil and constitute anywhere from 5 to 50 wt % active ingredient in additive concentrates as received from the manufacturer, the amount of viscosity modifiers used in the formulation on an active ingredient basis can also be expressed as being in the range of 0.20 to 4.0 wt % active ingredient, preferably 0.3 to 2.5 wt % active ingredient. For olefin copolymer and styrene-hydrogenated isoprene copolymer viscosity modifier, the active ingredient is in the range of 5 to 15 wt % in the additive concentrates from the manufacturer, the amount of these viscosity modifiers used in the formulation can also be expressed as being in the range of 0.20 to 1.9 wt % active ingredient, preferably 0.3 to 1.5 wt % active ingredient.

Lubricant compositions of the present disclosure may optionally include other conventional lubricant additives, such as antioxidants, anti-wear additives, pour point depressants, viscosity index modifiers, friction modifiers, defoaming agents, corrosion inhibitors, wetting agents, rust inhibitors, and seal swell agents. The additives may be incorporated to make a finished lubricant product that has desired viscosity and physical properties. Typically, additives will make up 10 wt % or less of the lubricant. Typical additives used in lubricant formulation can be found in the book "Lubricant Additives, Chemistry and Applications", Ed. L. R. Rudnick, Marcel Dekker, Inc. 270 Madison Ave. New York, N.Y. 10016, 2003

Lubricant compositions of the present disclosure are useful as oils or greases for any device or apparatus requiring lubrication of moving and/or interacting mechanical parts, components, or surfaces, particularly at high temperatures, e.g., 100° C. or more, and more particularly at 100° C. to 150° C. Useful apparatuses include engines and machines. The lubricant compositions are useful in the formulation of automotive crank-case lubricants, automotive gear oils, transmission oils, and industrial lubricants including circulation lubricant, industrial gear lubricants, grease, compressor oil, pump oils, refrigeration lubricants, hydraulic lubricants, and metal working fluids. Lubricant compositions are particularly useful in automotive applications as crank-case oil, i.e., motor oil or engine oil.

The lubricant compositions of this disclosure are particularly useful in any mechanical system in which rubbing surfaces exist. Mechanical components may have in such systems may include bearings (e.g. sliding, rolling, reciprocating), gears, pumps, cylinder liners, and piston rings. The lubricant compositions are particularly useful, for instance, in engines and power plants used in transportation vehicles, such as internal combustion engines, hybrid engines and systems, pneumatic engines and systems, electrical engines and systems, and alternate fuel engines. The lubricant compositions are also useful in conjunction with alternative fuels such as biofuels and alcohol-type fuels.

Internal combustion engine lubricating oils optionally have antiwear and/or extreme pressure (EP) additives therein to provide adequate antiwear protection for the engine. Increasingly specifications for engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$, wherein $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from 3 to 30 carbon atoms, preferably 3-20 carbon atoms. The olefinic compounds contain at least one non-aromatic double bond. Such compounds are defined by the formula $$R^3R^4C{=}CR^5R^6$$

wherein each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as molysulfur alkyl dithiocarbamate trimer complex (R=$C_8$-$C_{18}$ alkyl) are also useful antiwear agents. The use or addition of such materials should be kept to a minimum if the object is to produce low SAP formulations. Each of the aforementioned patents is incorporated by reference herein in its entirety.

Esters of glycerol may be used as antiwear agents. For example, mono-, di-, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties. Each of the aforementioned patents is incorporated herein by reference in its entirety.

Preferred antiwear additives include phosphorus and sulfur compounds such as zinc dithiophosphates and/or sulfur, nitrogen, boron, molybdenum phosphorodithioates, molybdenum dithiocarbamates and various organomolybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of 0.01 to 6 wt %, preferably 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

The lubricant optionally contains one or more antioxidants to retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products (recited above), and U.S. Pat. Nos. 4,798,684 and 5,084,197, for example, each of which is incorporated by reference herein in its entirety.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic mono-amines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamine s, phenothiazines, imidodibenzyls, and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alphanaphthylamine; phenyl-alphanaphthylamine; and p-octylphenyl-alphanaphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Preferred antioxidants include hindered phenols, arylamines. These antioxidants may be used individually by type or in combination with one another. Such additives may be used in an amount of 0.01 to 5 wt %, preferably 0.01 to 1.5 wt %, more preferably zero to less than 1.5 wt %, most preferably zero.

The lubricant optionally contains one or more detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Some compositions are overbased, i.e., containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of 1.05:1 to 50:1 on an equivalent basis. More preferably, the ratio is from 4:1 to 25:1. The resulting detergent is an overbased detergent that will typically have a TBN of 150 or higher, often 250 to 450 or more. Preferably, the overbasing cation is sodium, calcium, or magnesium. A mixture of detergents of differing TBN can be used in the present disclosure.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have 3 to 70 carbon atoms. The alkaryl sulfonates typically contain 9 to 80 carbon or more carbon atoms, more typically from 16 to 60 carbon atoms.

Klamann in Lubricants and Related Products, described above, discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

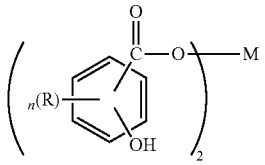

where R is a hydrogen atom or an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. U.S. Pat. No. 3,595,791 discloses additional information on synthesis thereof. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is 0.01 to 6.0 wt %, preferably, 0.1 to 0.4 wt % based on the total weight of the lubricant composition.

During engine operation, oil-insoluble oxidation byproducts are produced. Dispersants help keep these byproducts in solution, thus diminishing their deposition on metal surfaces. Lubricants of the present disclosure optionally contain one or more dispersants. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458. Other dispersants are described, for example, in European Patent Application No. 471071.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from 1:1 to 5:1. Representative examples are shown in U.S. Pat. Nos. 3,087,936; 3,172,892; 3,219,666; 3,272,746; 3,322,670; 3,652,616; and 3,948,800; and Canadian Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this disclosure include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209 and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 wt %, preferably 0.1 to 8 wt %, based on the total weight of the composition.

The lubricant composition optionally may contain conventional pour point depressants (also known as lube oil flow improvers). The pour point depressant may be added to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of 0.01 to 5 wt %, preferably 0.01 to 1.5 wt % based on the total weight of the composition.

The lubricant composition optionally may contain corrosion inhibitors to reduce the degradation of metallic parts that are in contact with the composition. Suitable corrosion inhibitors include thiadiazoles. See, for example, U.S. Pat. Nos. 2,719,125; 2,719,126; and 3,087,932. Such additives may be used in an amount of 0.01 to 5 wt %, preferably 0.01 to 1.5 wt % based on the total weight of the composition.

The lubricant composition optionally may contain seal compatibility agents to help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of 0.01 to 3 wt %, preferably 0.01 to 2 wt % based on the total weight of the composition.

The lubricant composition optionally may contain anti-foam agents. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent based on the total weight of the composition.

The lubricant composition optionally may contain antirust additives (or corrosion inhibitors), which are additives that protect lubricated metal surfaces against chemical attack by water or other contaminants. A wide variety of these are commercially available; they are referred to in Klamann in Lubricants and Related Products as cited previously.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 wt %, preferably 0.01 to 1.5 wt % based on the total weight of the composition.

The lubricant composition optionally may contain a friction modifier, which is any substance(s) that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. Disclosure of the foregoing is described in U.S. Pat. Nos. 5,824,627; 6,232,276; 6,153,564; 6,143,701; 6,110,878; 5,837,657; 6,010,987; 5,906,968; 6,734,150; 6,730,638; 6,689,725; and 6,569,820 as well as in patent publications WO 99/66013; WO 99/47629; and WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from 0.01 wt % to 10-15 wt % or more, often with a preferred range of 0.1 wt % to 5 wt % based on the total weight of the composition. Concentrations of molybdenum-containing materials are often described in terms of Mo metal concentration. Advantageous concentrations of Mo may range from 10 ppm to 3000 ppm or more, and often with a preferred range of 20-2000 ppm, and in some instances a more preferred range of 30-1000 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

Note that some additives are shipped from the manufacturer and used with a certain amount of base oil solvent in the formulation. Accordingly, the weight amounts in the table below, as well as other amounts mentioned in this patent, unless otherwise indicated are directed to the amount of active ingredient (that is the non-solvent portion of the ingredient). The wt % indicated below are based on the total weight of the lubricating oil composition.

TABLE 1

Typical Amounts of Various Lubricant Oil Components

| Compound | Approximate wt % (useful) | Approximate wt % (preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base stock or base oil | Balance | Balance |

The lubricant can be employed in a variety of end uses, such as a lubricant oil, an industrial oil, a hydrolytic oil, an engine oil, and a grease.

The following are examples are examples of the present disclosure and are not to be deemed as limiting.

EXAMPLES

Example 1

Various esters of the present disclosure and comparative alkyl dimers were tested for $KV_{100}$, $KV_{150}$, (KV=kinematic viscosity at 100° C. and 150° C.) and viscosity index (VI). $KV_{150}/KV_{100}$ Ratio and VI are set forth in Table 2 below and in FIG. 1. The bars in FIG. 1 denote KV150/KV100 Ratio and squares denote viscosity indexes.

TABLE 2

($KV_{150}/KV_{100}$ Ratio and Viscosity Index for the Esters of Example 1)

| Commercial Name | Chemical Name | KV150/KV100 | VI |
|---|---|---|---|
| Crodamol-OS-LQ | ethylhexyl stearate | 0.572 | 165.9 |
| Radia 7127 | 2-ethylhexyl laurate | 0.615 | 144.3 |
| Radia 7241 | isobutyl stearate | 0.580 | 173.6 |
| Radia 7333 | 2-ethylhexyl oleate | 0.564 | 174.8 |
| Radia 7051 | butyl stearate | 0.578 | 193.0 |
| Vinycizer 30 | Isobutyl oleate | 0.605 | 208.3 |
| Dermol 89 | Ethylhexyl Isononanoate | 0.613 | 98.5 |
| Synative ES 2911 | Isodecyl Pelargonate | 0.633 | 142.8 |
| Vinycizer 40 | Dibutyl Adipate | 0.646 | 100.9 |
| Esterex M11 | isononyl heptanoate | 0.629 | 160.3 |
| Spectrasyn 2* | Decene Dimer | 0.602 | 91.4 |
| Spectrasyn 4* | Decene Trimer | 0.478 | 123.9 |
| Esterex M31 | Ethyl hexly palmitate | 0.574 | 155.4 |
| Synative ES 932M | Monoester (unsat) | 0.723 | 147.5 |
| Synative ES 2917 | Polyol Ester | 0.592 | 134.7 |
| Synative ES 2925 | TMP ester | 0.493 | 138.8 |
| Synative ES 2958 | Diester | 0.537 | 146.2 |
| Esterex NP 343 | TMP ester | 0.491 | 132.8 |
| Esterex NP 341 | TMP ester | 0.494 | 129.8 |
| Esterex A32 | Diester | 0.570 | 144.4 |

*not an example of the present disclosure

Example 2 and Comparative Examples 1 to 3

Figure 2:
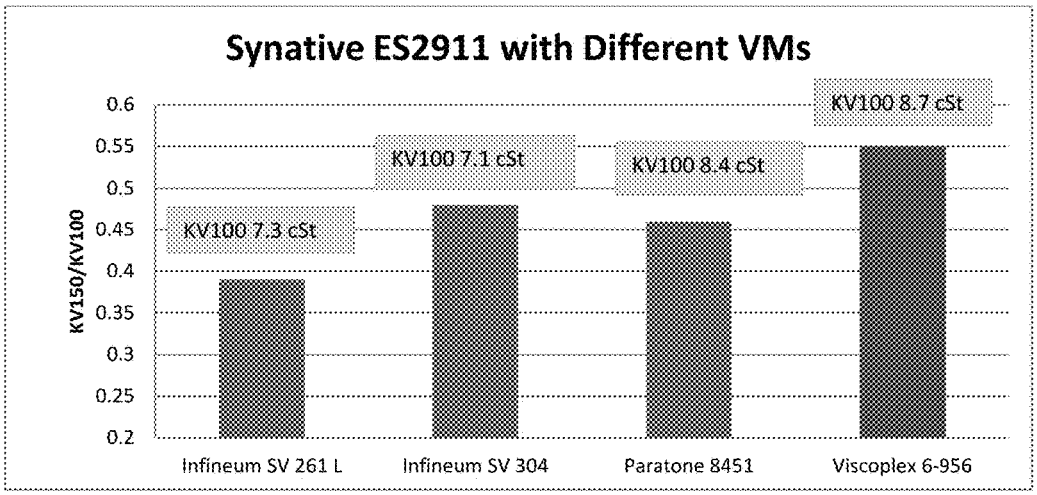
FIG. 2 depicts a bar graph for $KV_{150}/KV_{100}$ Ratio for the esters of Example 2 and Comparative Examples 1 to 3.
Figure 3:
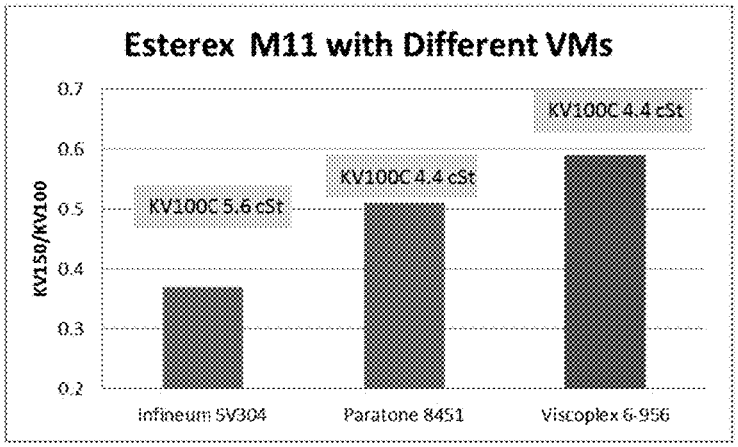
FIG. 3 depicts a bar graph of $KV_{150}/KV_{100}$ Ratio data for the esters of Example 3 and Comparative Examples 4 and 5.

Blends of ester and viscosity modifying polymers were prepared and tested for $KV_{150}/KV_{100}$ Ratio. The ester employed was Synative ES 2911 (isodecyl pelargonate) (BASF Chemicals). The blend of Synative ES 2911 and Viscoplex 6-956 (polyalkyl methacrylate) (Evonik) exhibited a favorable $KV_{150}/KV_{100}$ Ratio of 0.55. Results are set forth in Table 3 below and FIG. 2. Infineum SV 304 and 261L are hydrogenated block copolymers of styrene and isoprene viscosity modifiers from Infineum; Paratone 8451 is a copolymer of ethylene and propylene viscosity modifier from Oronite; Viscoplex 6-956 is a polymethacrylate viscosity modifier from Evonik.

TABLE 3

($KV_{150}/KV_{100}$ Ratio for the Ester of Example 2 and Comparative Examples 1 to 3)

| Components | Comp. Ex. 1 wt % | Comp. Ex. 2 wt % | Comp. Ex. 3 wt % | Example 2 wt % |
|---|---|---|---|---|
| Infineum SV261L | 15 | | | |
| INF SV304 | | 15 | | |
| PARATONE 8451 | | | 20 | |
| VISCOPLEX 6-956 | | | | 15 |
| SYNATIVE ES 2911 | 85 | 85 | 80 | 85 |
| Tests | Results | Results | Results | Results |
| Kinematic Viscosity at 40° C., cSt | 24.42 | 22.83 | 30.58 | 26.93 |
| Kinematic Viscosity at 100° C., cSt | 7.32 | 7.12 | 8.44 | 8.71 |
| Kinematic Viscosity at 150° C., cSt | 2.89 | 3.47 | 3.91 | 4.75 |
| $KV_{150}/KV_{100}$ | 0.39 | 0.49 | 0.46 | 0.55 |

Example 3 and Comparative Examples 4 and 5

Figure 4:
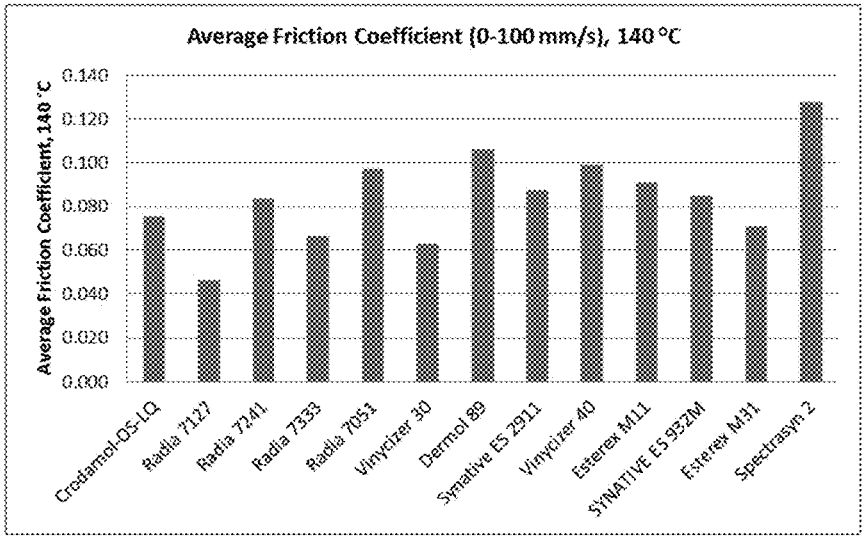
FIG. 4 depicts a bar graph for data for average friction coefficients for the esters of Example 4.

The effect of the addition of different viscosity modifiers to an ester, Esterex M11, was measured and compared. The blend of Viscoplex 6-956 and Esterex M11 was found to exhibit an advantageous viscosity-temperature relationship between 100° C. and 150° C. Results are set forth in Table 4 below and FIG. 4.

TABLE 4

($KV_{150}/KV_{100}$ Ratio Data for the Ester of Example 3 and Comparative Examples 4 and 5)

| Components | Comp. Ex. 4 wt % | Comp. Ex. 5 wt % | Example 3 wt % |
|---|---|---|---|
| INFINEUM SV304 | 15 | | |
| PARATONE 8451 | | 15 | |
| VISCOPLEX 6-956 | | | 10 |
| Esterex M11 | 85 | 85 | 90 |
| Tests | Results | Results | Results |
| Kinematic Viscosity at 40° C., cSt | 16.15 | 12.75 | 11.46 |
| Kinematic Viscosity at 100° C., cSt | 5.63 | 4.44 | 4.36 |
| Kinematic Viscosity at 150° C., cSt | 2.11 | 2.28 | 2.59 |
| KV150/KV100 | 0.37 | 0.51 | 0.59 |

Example 4

Various esters were tested for friction coefficient using a PCS Mini Traction Machine (MTM), with a 19.05 mm (¾ inch) steel ball and a 46 mm diameter steel disc. The slide to roll ratio was fixed at 50% and the speed was varied from 0 to 300 mm/s at 1.0 GPa contact pressure (37 N load) and 140° C., 20 data points were obtained between 0 to 100 mm/s (spaced based on a logarithmic scale). The average of these 20 data points for each component was reported here as the average friction coefficient. Results are set forth in Table 5 below and FIG. 4.

TABLE 5

(Data for Average Friction Coefficients for the Esters of Example 4)

| Commercial Name | chemical Name | Average Friction Coefficient (0-100 mm/s) |
|---|---|---|
| Crodamol-OS-LQ | ethylhexyl stearate | 0.075 |
| Radia 7127 | 2-ethylhexyl laurate | 0.046 |
| Radia 7241 | isobutyl stearate | 0.084 |
| Radia 7333 | 2-ethylhexyl oleate | 0.067 |
| Radia 7051 | butyl stearate | 0.097 |
| Vinycizer 30 | Isobutyl oleate | 0.063 |
| Dermol 89 | Ethylhexyl Isononanoate | 0.106 |
| Synative ES 2911 | Isodecyl Pelargonate | 0.088 |
| Vinycizer 40 | Dibutyl Adipate | 0.099 |
| Esterex M11 | isononyl heptanoate | 0.091 |
| Synative ES 932M | Monoester (unsat) | 0.085 |
| Esterex M31 | Ethyl hexly palmitate | 0.071 |
| Spectrasyn 2* | Decene Dimer | 0.128 |

*not an example of the present disclosure

Examples 5 and 6 and Comparative Example 6

A comparison of Radia 7127 (2-ethylhexyl laurate), Synative ES 2911 (Isodecyl Pelargonate) and Spectrasyn 2 (PAO2) in a fully formulated lubricant formulation containing relatively high Zn dialkyl dithiophosphate (ZDDP) and Infineum SV261L viscosity modifier was carried out. Average friction coefficient was measured using a PCS Mini Traction Machine (MTM), with a 19.05 mm (¾ inch) steel ball and a 46 mm diameter steel disc. The slide to roll ratio was fixed at 50% and the speed was varied from 0 to 300 mm/s and repeated for 4 times at 1.0 GPa contact pressure and 140° C. For the $4^{th}$ run, 20 data points were obtained between 0 to 100 mm/s (spaced based on a logarithmic scale). The average of these 20 data points for each formulation was reported here as the average friction coefficient. The results are set forth in Table 6 below.

TABLE 6

(Data for Average Friction Coefficients for the Esters of Examples 5 and 6 and Comparative Example 6)

| Chemical Type | Example 5, wt % | Example 6, wt % | Comp. Ex. 6, wt % |
|---|---|---|---|
| Antioxidant | 1.0 | 1.0 | 1.0 |
| Antifoam | 0.3 | 0.3 | 0.3 |
| Overbased Detergents | 1.5 | 1.5 | 1.5 |
| Neutral Detergent | 0.5 | 0.5 | 0.5 |
| ZDDP | 1.9 | 1.9 | 1.9 |

TABLE 6-continued (Data for Average Friction Coefficients for the Esters of Examples 5 and 6 and Comparative Example 6)

| | Chemical Type | Example 5, wt % | Example 6, wt % | Comp. Ex. 6, wt % |
|---|---|---|---|---|
| | Dispersant | 1 | 1 | 1 |
| | Borated Dispersant | 1 | 1 | 1 |
| | High Molecular Weight PAO | 3 | 3 | 3 |
| | Infineum SV261L | 23.36 | 23.90 | 23.9 |
| | Radia 7127 (2-ethylhexyl laurate) | 66.44 | | |
| | Synative ES 2911 (Isodecyl Pelargonate) | | 65.90 | |
| | Spectrasyn 2 (PAO 2) | | | 65.9 |
| ASTM D445 Kinematic Viscosity, 40° C., $mm^2/s$ | Kinematic Viscosity, 40° C. | 72.76 | 75.13 | 76.38 |
| ASTM D445 Kinematic Viscosity, 100° C., $mm^2/s$ | Kinematic Viscosity, 100° C. | 17.49 | 18.18 | 17.06 |
| ASTM D445 Kinematic Viscosity, 150° C., $mm^2/s$ | Kinematic Viscosity, 150° C. | 8.53 | 8.87 | 8.18 |
| KV150/KV100 | KV150/KV100 ratio | 0.49 | 0.49 | 0.48 |
| VI | Viscosity Index | 260 | 263 | 242 |
| ASTM D6616 Apparent Viscosity, cP | Apparent Viscosity, high shear 100° C., cP | 6.79 | 6.86 | 6.41 |
| ASTM D4683 Apparent Viscosity, cP | Apparent Viscosity, high shear 150° C.,cP | 4.00 | 4.00 | 3.53 |
| | High Shear Viscosity Ratio (150/100) | 0.59 | 0.58 | 0.55 |
| ASTM D5293 CCS, −35 C., cP | App. Viscosity @ −35 C. | 710 | 690 | 1000 |
| ASTM D5185, BORON, ppm | BORON | 81 | 83 | 83 |
| ASTM D5185 CALCIUM, ppm | CALCIUM | 1270 | 1280 | 1280 |
| ASTM D5185 MAGNESIUM, ppm | MAGNESIUM | 508 | 525 | 525 |
| ASTM D5185 PHOSPHORUS, ppm | PHOSPHORUS | 1710 | 1750 | 1740 |
| ASTM D5185 SILICON, ppm | SILICON | 14 | 14 | 14 |
| ASTM D5185 ZINC, ppm | ZINC | 1900 | 1930 | 1910 |
| ASTM D92 Flash Point, Cleveland Open Cup, ° C. | Flash Point, Cleveland Open Cup | 198 | 182 | 169 |
| ASTM D93 Flash Point, Pensky Martens Closed Cup, ° C. | Flash Point, Pensky Martens Closed Cup, ° C. | 178 | 172 | 158 |
| MTM Average Friction Coefficient (0-100 mm/s) | Friction Coefficient, 140° C. | 0.089 | 0.10 | 0.12 |

Examples 7 and 8 and Comparative Example 7

A comparison of Radia 7127 (2-ethylhexyl laurate), Synative ES 2911 (Isodecyl Pelargonate) and Spectrasyn 2 (PAO2) in a fully formulated lubricant formulation containing medium Zn dialkyl dithiophosphate (ZDDP) and polymethacrylate viscosity modifier was carried out. Friction coefficient was measured using a PCS Mini Traction Machine (MTM), with a 19.05 mm (¾ inch) steel ball and a 46 mm diameter steel disc. The slide to roll ratio was fixed at 50% and the speed was varied from 0 to 300 mm/s and repeated for 4 times at 1.0 GPa contact pressure and 140° C. For the $4^{th}$ run, 20 data points were obtained between 0 to 100 mm/s (spaced based on a logarithmic scale). The average of these 20 data points for each formulation was reported here as the average friction coefficient. Results are set forth below in Table 7.

TABLE 7

(Data for Average Friction Coefficients for the Esters of Examples 7 and 8 and Comparative Example 7)

| Chemical Type | Example 7, wt % | Example 8, wt % | Comp. Ex. 7, wt % |
|---|---|---|---|
| Antioxidant | 1.0 | 1.0 | 1.0 |
| Antifoam | 0.3 | 0.3 | 0.3 |
| Overbased Detergents | 1.5 | 1.5 | 1.5 |
| Neutral Detergent | 0.5 | 0.5 | 0.5 |
| ZDDP | 0.8 | 0.8 | 0.8 |
| Dispersant | 1 | 1 | 1 |
| Borated Dispersant | 1 | 1 | 1 |
| High Molecular Weight PAO | 3 | 3 | 3 |
| Viscoplex 6-956 | 19.01 | 19.51 | 19.51 |
| Radia 7127 (2-ethylhexyl laurate) | 71.89 | | |

TABLE 7-continued (Data for Average Friction Coefficients for the Esters of Examples 7 and 8 and Comparative Example 7)

| | Chemical Type | Example 7, wt % | Example 8, wt % | Comp. Ex. 7, wt % |
|---|---|---|---|---|
| | Synative ES 2911 (Isodecyl Pelargonate) | | 71.39 | |
| | Spectrasyn 2 (PAO 2) | | | 71.39 |
| ASTM D445 Kinematic Viscosity, 40° C., $mm^2/s$ | Kinematic Viscosity, 40° C. | 51.41 | 54.32 | 41.72 |
| ASTM D445 Kinematic Viscosity, 100° C., $mm^2/s$ | Kinematic Viscosity, 100° C. | 14.66 | 15.35 | 11.94 |
| ASTM D445 Kinematic Viscosity, 150° C., $mm^2/s$ | Kinematic Viscosity, 150° C. | 7.73 | 8.14 | 6.42 |
| KV150/KV100 | KV150/KV100 ratio | 0.53 | 0.53 | 0.54 |
| VI | Viscosity Index | 300 | 298 | 296 |
| ASTM D6616 Apparent Viscosity, CP | Apparent Viscosity, high shear 100° C., cP | 7.63 | 7.92 | 6.48 |
| ASTM D4683 Apparent Viscosity, cP | Apparent Viscosity, high shear 150° C., cP | 4.39 | 4.48 | 3.59 |
| | High Shear Viscosity Ratio (150/100) | 0.58 | 0.57 | 0.55 |
| ASTM D5293 CCS, −35° C., cP | App. Viscosity @ −35 C. | 1130 | 1230 | 1080 |
| ASTM D5185, BORON, ppm | BORON | 82 | 82 | 84 |
| ASTM D5185 CALCIUM, ppm | CALCIUM | 1260 | 1300 | 1280 |
| ASTM D5185 MAGNESIUM, ppm | MAGNESIUM | 513 | 503 | 525 |
| ASTM D5185 PHOSPHORUS, ppm | PHOSPHORUS | 691 | 679 | 689 |
| ASTM D5185 SILICON, ppm | SILICON | 12 | 13 | 15 |
| ASTM D5 185 ZINC, ppm | ZINC | 766 | 757 | 756 |
| ASTM D92 Flash Point, Cleveland Open Cup, ° C. | Flash Point, Cleveland Open Cup | 190 | 194 | 160 |
| ASTM D93 Flash Point, Pensky Martens Closed Cup, ° C. | Flash Point, Pensky Martens Closed Cup, ° C. | 177 | 161 | |
| MTM Average Friction Coefficient (0-100 mm/s) | Friction Coefficient, 140° C. | 0.103 | 0.109 | 0.114 |

Examples 9 and 10 and Comparative Example 8

A comparison of Radia 7127 (2-ethylhexyl laurate), Synative ES 2911 (Isodecyl Pelargonate) and Spectrasyn 2 (PAO2) in a fully formulated lubricant formulation containing low overbased detergent, low Zn dialkyl dithiophosphate (ZDDP), and polymethacrylate viscosity modifier is carried out. Friction coefficient is measured using a PCS Mini Traction Machine (MTM), with a 19.05 mm steel ball (¾ inch) and a 46 mm diameter steel disc. The slide to roll ratio is fixed at 50% and the speed is varied from 0 to 300 mm/s and repeated for 4 times at 1.0 GPa contact pressure and 140° C. For the $4^{th}$ run, 20 data points are obtained between 0 to 100 mm/s (spaced based on a logarithmic scale). The average of these 20 data points for each formulation is reported as the average friction coefficient. The formulations are set forth below in Table 8.

TABLE 8

(Data for Average Friction Coefficients for the Esters of Examples 9 and 10 and Comparative Example 8)

| Chemical Type | Example 9, wt % | Example 10, wt % | Comp. Ex. 8, wt % |
|---|---|---|---|
| Antioxidant | 1.0 | 1.0 | 1.0 |
| Antifoam | 0.3 | 0.3 | 0.3 |
| Overbased Detergents | 0.5 | 0.5 | 0.5 |
| Neutral Detergent | 0.5 | 0.5 | 0.5 |
| ZDDP | 0.5 | 0.5 | 0.5 |
| Dispersant | 1 | 1 | 1 |
| Borated Dispersant | 1 | 1 | 1 |
| High Molecular Weight PAO | 3 | 3 | 3 |

TABLE 8-continued (Data for Average Friction Coefficients for the Esters of Examples 9 and 10 and Comparative Example 8)

| Chemical Type | Example 9, wt % | Example 10, wt % | Comp. Ex. 8, wt % |
|---|---|---|---|
| Viscoplex 6-956 | 19.01 | 19.51 | 19.51 |
| Radia 7127 (2-ethylhexyl laurate) | 73.19 | | |
| Synative ES 2911 (Isodecyl Pelargonate) | | 72.69 | |
| Spectrasyn 2 (PAO 2) | | | 72.69 |

Examples 11 and 12 and Comparative Example 9

A comparison of Radia 7127 (2-ethylhexyl laurate), Synative ES 2911 (Isodecyl Pelargonate) and Spectrasyn 2 (PAO2) in a fully formulated lubricant formulation containing low overbased detergent, low Zn dialkyl dithiophosphate (ZDDP), and Infineum SV261L viscosity modifier is carried out. Friction coefficient is measured using a PCS Mini Traction Machine (MTM), with a 19.05 mm (¾ inch) steel ball and a 46 mm diameter steel disc. The slide to roll ratio is fixed at 50% and the speed is varied from 0 to 300 mm/s and repeated for 4 times at 1.0 GPa contact pressure and 140° C. For the $4^{th}$ run, 20 data points are obtained between 0 to 100 mm/s (spaced based on a logarithmic scale). The average of these 20 data points for each formulation is reported as the average friction coefficient. The formulations are set forth below in Table 9.

TABLE 9

(Data for Average Friction Coefficients for the Esters of Examples 11 and 12 and Comparative Example 9)

| Chemical Type | Example 11, wt % | Example 12, wt % | Comp. Ex. 9, wt % |
|---|---|---|---|
| Antioxidant | 1.0 | 1.0 | 1.0 |
| Antifoam | 0.3 | 0.3 | 0.3 |
| Overbased Detergents | 0.5 | 0.5 | 0.5 |
| Neutral Detergent | 0.5 | 0.5 | 0.5 |
| ZDDP | 0.5 | 0.5 | 0.5 |
| Dispersant | 1 | 1 | 1 |
| Borated Dispersant | 1 | 1 | 1 |
| High Molecular Weight PAO | 3 | 3 | 3 |
| Infineum SV 261L | 20.00 | 20.00 | 20.00 |
| Radia 7127 (2-ethylhexyl laurate) | 72.20 | | |
| Synative ES 2911 (Isodecyl Pelargonate) | | 72.20 | |
| Spectrasyn 2 (PAO 2) | | | 72.20 |

PCT and EP Clauses:

1. A high-temperature lubricant composition, comprising an amount of an ester, wherein the ester exhibits a kinematic viscosity at 100° C. of 1 to 4 centistokes and a kinematic viscosity ratio at 150° C./100° C. of 0.6 or higher, wherein the composition is at a temperature of 100° C. to 150° C.

2. The composition of clause 1, wherein the ester exhibits an average friction coefficient of 1.0 or lower at 140° C.

3. The composition of clause 1, wherein the ester exhibits an average friction coefficient of 0.8 or lower at 140° C.

4. The composition of clauses 1-3, wherein the amount of the ester is present at 50 wt % or more of the composition based on the total weight of the composition.

5. The composition of clauses 1-3, wherein the amount of the ester is present at 80 wt % or more of the composition based on the total weight of the composition.

6. The composition of clauses 1-5, wherein the ester is selected from the group consisting of ethylhexyl stearate, 2-ethylhexyl laurate, isobutyl stearate, 2-ethylhexyl oleate, butyl stearate, isobutyl oleate, ethylhexyl isononanoate, isodecyl pelargonate, dibutyl adipate, isononyl heptanoate, ethylhexyl palmitate, isononyl otanoate, isononyl isononanoate, isodecyl isononanoate, isodecyl ethylhexanoate, isotearyl isononanoate, diisooctyl adipate, diethylhexyl adipate, di-n-octyl adipate, diisopropyl sabacate, diisobutyl sabacate, diisohexyl sabacate, diisobutyl azelate, diisooctyl azelate, diethylhexyl azelate, diisohexyl azelate.

7. A method for improving the operating efficiency of an engine having a crankcase lubricant, wherein the lubricant composition of clauses 1-6 is added to the crankcase.

8. A lubricant composition, comprising a polymeric viscosity modifier in an amount of 5 wt % to 35 wt % and an amount of an ester 95 wt % to 10 wt % based on the total weight of the composition, wherein the ester exhibits a kinematic viscosity at 100° C. of 1 to 4 centistokes and a kinematic viscosity ratio at 150° C./100° C. of 0.60 or higher, wherein the amount of the polymeric viscosity modifier and the amount of the ester are present at 80 wt % or more of the composition based on the total weight of the composition.

9. The composition of clause 8, wherein the composition is at a temperature of 100° C. to 150° C.

10. The composition of clauses 8-9, wherein the ester exhibits an average friction coefficient of 1.0 or lower at 140° C.

11. The composition of clauses 8-9, wherein the ester exhibits an average friction coefficient of 0.8 or lower at 140° C.

12. The composition of clauses 8-11, wherein the polymeric viscosity modifier is selected from the group consisting of polymethacrylates, copolymers of ethylene and propylene, hydrogenated block copolymers of styrene and isoprene or of styrene and butadiene.

13. The composition of clauses 8-12, wherein the polymeric viscosity modifier is a polymethacrylate.

14. The composition of clauses 8-13, wherein the composition the combination of polymeric viscosity modifier and ester has a kinematic viscosity ratio at 150° C./100° C., of 0.55 or higher.

15. A method for improving the operating efficiency of an engine having a crankcase lubricant, wherein the lubricant composition of clauses 8-14 added to the crankcase.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A high-temperature lubricant composition, comprising an amount of a monoester of 90 wt % or more of the composition based on the total weight of the composition, wherein the monoester exhibits a kinematic viscosity at 100° C. of 1 to 4 centistokes and a kinematic viscosity ratio at 150° C./100°C. of 0.6 or higher, wherein the composition is at a temperature of 100° C. to 150° C., and wherein the monoester is selected from the group consisting of 2-ethylhexyl laurate, isobutyl stearate, isobutyl oleate, ethylhexyl isononanoate, isodecyl pelargonate, isononyl heptanoate, isononyl otanoate, isononyl isononanoate, isodecyl isononanoate, and isodecyl ethylhexanoate.

2. The composition of claim 1, wherein the monoester exhibits an average friction coefficient of 1.0 or lower at 140° C.

3. The composition of claim 1, wherein the monoester exhibits an average friction coefficient of 0.8 or lower at 140° C.

4. A method for improving the operating efficiency of an engine having a crankcase lubricant, wherein the lubricant composition of claim 1 is added to the crankcase.

5. A lubricant composition, comprising a polymeric viscosity modifier in an amount of 5 wt % to 10 wt % and an amount of a monoester 95 wt % to 90 wt % based on the total weight of the composition, wherein the ester exhibits a kinematic viscosity at 100° C. of 1 to 4 centistokes and a kinematic viscosity ratio at 150° C./100° C. of 0.60 or higher, wherein the amount of the polymeric viscosity modifier and the amount of the monoester are present at 90 wt % or more of the composition based on the total weight of the composition, and wherein the monoester is selected from the group consisting of 2-ethylhexyl laurate, isobutyl stearate, isobutyl oleate, ethylhexyl isononanoate, isodecyl pelargonate, isononyl heptanoate, isononyl otanoate, isononyl isononanoate, isodecyl isononanoate, and isodecyl ethylhexanoate.

6. The composition of claim 5, wherein the composition is at a temperature of 100° C. to 150° C.

7. The composition of claim 5, wherein the monoester exhibits an average friction coefficient of 1.0 or lower at 140° C.

8. The composition of claim 5, wherein the monoester exhibits an average friction coefficient of 0.8 or lower at 140° C.

9. The composition of claim 5, wherein the polymeric viscosity modifier is selected from the group consisting of polymethacrylates, copolymers of ethylene and propylene, hydrogenated block copolymers of styrene and isoprene or of styrene and butadiene.

10. The composition of claim 5, wherein the polymeric viscosity modifier is a polymethacrylate.

11. The composition of claim 5, wherein the composition the combination of polymeric viscosity modifier and monoester has a kinematic viscosity ratio at 150° C./100° C. of 0.55 or higher.

12. A method for improving the operating efficiency of an engine having a crankcase lubricant, wherein the lubricant composition of claim 5 added to the crankcase.

* * * * *